United States Patent [19]

Friedman et al.

[11] Patent Number: 4,463,874

[45] Date of Patent: Aug. 7, 1984

[54] VENDING MACHINE HAVING CARD MOVING FINGERS

[75] Inventors: Evelyn Friedman, Whitehall; Martin A. Borho, Ticonderoga; William R. Carswell, Whitehall, all of N.Y.; Frank Kecseti, Winston Salem, N.C.

[73] Assignee: E B Metal Industries Inc., Whitehall, N.Y.

[21] Appl. No.: 379,305

[22] Filed: May 18, 1982

[51] Int. Cl.[3] ..... B65H 1/06

[52] U.S. Cl. ..... 221/238; 271/135; 271/137

[58] Field of Search ..... 221/271, 272–276, 221/238, 232, 262, 261, 125, 129, 298, 299; 414/126; 271/135, 137

[56] References Cited

U.S. PATENT DOCUMENTS

| | | | |
|---|---|---|---|
| 34,245 | 1/1862 | Duffield . | |
| 58,357 | 9/1866 | Lamontague . | |
| 538,173 | 4/1895 | Loewenbach et al. . | |
| 804,013 | 11/1905 | Klein . | |
| 919,927 | 4/1909 | Neumann et al. . | |
| 984,785 | 2/1911 | Towne . | |
| 988,570 | 4/1911 | Hassmann . | |
| 1,044,622 | 11/1912 | Amadeo . | |
| 2,603,253 | 7/1952 | Leash | 221/238 |
| 2,673,133 | 12/1951 | Koch | 312/55 |
| 2,829,799 | 4/1958 | Johanson | 221/293 |
| 3,292,820 | 12/1966 | Klingler et al. | 221/293 |
| 3,439,834 | 4/1969 | Carter, Jr. | 221/7 |
| 3,439,834 | 4/1969 | Carter, Jr. | 221/7 |
| 4,249,672 | 2/1981 | Rossi | 221/264 |

FOREIGN PATENT DOCUMENTS

| | | | |
|---|---|---|---|
| 1561418 | 3/1970 | Fed. Rep. of Germany | 271/135 |

*Primary Examiner*—Stanley H. Tollberg

*Attorney, Agent, or Firm*—Edgar N. Jay; Ronald A. Schapira

[57] ABSTRACT

A dispenser for a stack of horizontally disposed, rectangular cards or the like and a product vending machine incorporating the dispenser. The dispenser features a magazine for the stack of cards and a dispensing chute beneath the magazine. Between the magazine and the chute, on one lateral side thereof, is a slider with a pair of laterally extending front and rear fingers that can be moved frontally and rearwardly against the front and rear edges, repectively, of the bottommost card of the stack. When the dispenser is actuated, the slider moves rearwardly so that its front finger urges the bottommost card to move rearwardly to an intermediate position in which the rear portions of the card are restrained from moving downwardly while the front portions of the card are free to move downwardly into the dispensing chute. Then, the slider moves frontally so that its rear finger urges the bottommost card from the intermediate position frontally so that the rear portions of the card no longer restrain the card from moving downwardly into the dispensing chute.

14 Claims, 8 Drawing Figures

VENDING MACHINE HAVING CARD MOVING FINGERS

BACKGROUND OF THE INVENTION

This invention relates to a machine for automatically vending a product, such as a soft drink, chewing gum or cigarettes, when a consumer deposits the price of, and then selects, a product in the machine. This invention particularly relates to an apparatus in the vending machine for automatically dispensing a card, such as a coupon, after a consumer has deposited the price of, and selected, a product in the machine.

Devices for dispensing individual cards or the like from a stack are well known. See, for example, U.S. Pat. Nos. 34,245, 58,357, 538,173, 804,013, 919,927, 984,785, 988,570, 1,044,622, 2,673,133, 2,829,799, 3,439,834 and 4,249,672. However, card dispensing devices have generally utilized relatively complicated and unreliable mechanisms to separate a single card from the remainder of a stack. As a result, card dispensers have been prone to jam upon repeated use. There has been a need, therefore, for a simple and reliable, card dispenser.

SUMMARY OF THE INVENTION

In accordance with this invention, a simple and reliable card dispenser is provided for an automatic vending machine. The card dispenser comprises:

(a) a compartment for a vertical stack of horizontally disposed cards; the compartment having an open bottom through which the cards can move downwardly;

(b) a horizontal platform, below the compartment, having an opening, below the open bottom of the compartment, through which the cards can move downwardly from the compartment; a horizontal ledge being provided in the front of the opening, extending rearwardly, and a horizontal ledge being provided in the rear of the opening, extending frontally; the front and rear ledges being adapted to underlie simultaneously the stack of cards in the compartment; the lateral end portions of the bottom of the front wall of the compartment being vertically spaced above the top of the platform; and the bottom of the rear wall of the compartment being vertically spaced above the top of the platform by at least the vertical thickness of one of the cards;

(c) a slider, located on the platform on one lateral side of the compartment and adapted to move rearwardly and frontally along the platform; the slider having a pair of laterally extending, front and rear fingers, spaced farther apart than the front and rear edges of each of the cards; the fingers having a vertical thickness no greater than one of the cards; the fingers being adapted to move horizontally between the platform and the compartment so that: (1) the front finger can urge rearwardly the front edge of the bottom card of the stack when the bottom card is on the front ledge and on the rear finger; and (2) the rear finger can urge frontally the rear edge of the bottom card of the stack when the rear edge of the bottom card is in the vertical space between the rear wall of the compartment and the platform; and (d) means for moving the slider: (1) rearwardly so that the front finger moves rearwardly out of the vertical space between the lateral end portions of the front wall of the compartment and the platform and against the front edge of the bottom card of the stack and the rear finger moves rearwardly out from between the bottom card and the rear ledge and into the vertical space between the rear wall of the compartment and the platform; and then (2) frontally so that the rear finger moves frontally against the rear edge of the bottom card in the vertical space between the rear wall of the compartment and the platform and the front finger moves frontally into the vertical space between the lateral end portions of the front wall of the compartment and the platform.

BRIEF DESCRIPTION OF THE DRAWINGS

FIG. 2 shows the card dispenser before it has been activated to dispense a card by the deposit of money in the vending machine.

In FIG. 7, the elements of the card dispenser have returned to their original position, as shown in FIG. 4, after dispensing a card.

DETAILED DESCRIPTION OF THE INVENTION

Although the principles of this invention are applicable to other vending machines, the invention will be fully understood from an explanation of its application to a preferred embodiment of a vending machine, generally 10, for automatically dispensing different products (e.g., different soft drinks) as shown in FIGS. 1 to 8.

Figure 1:
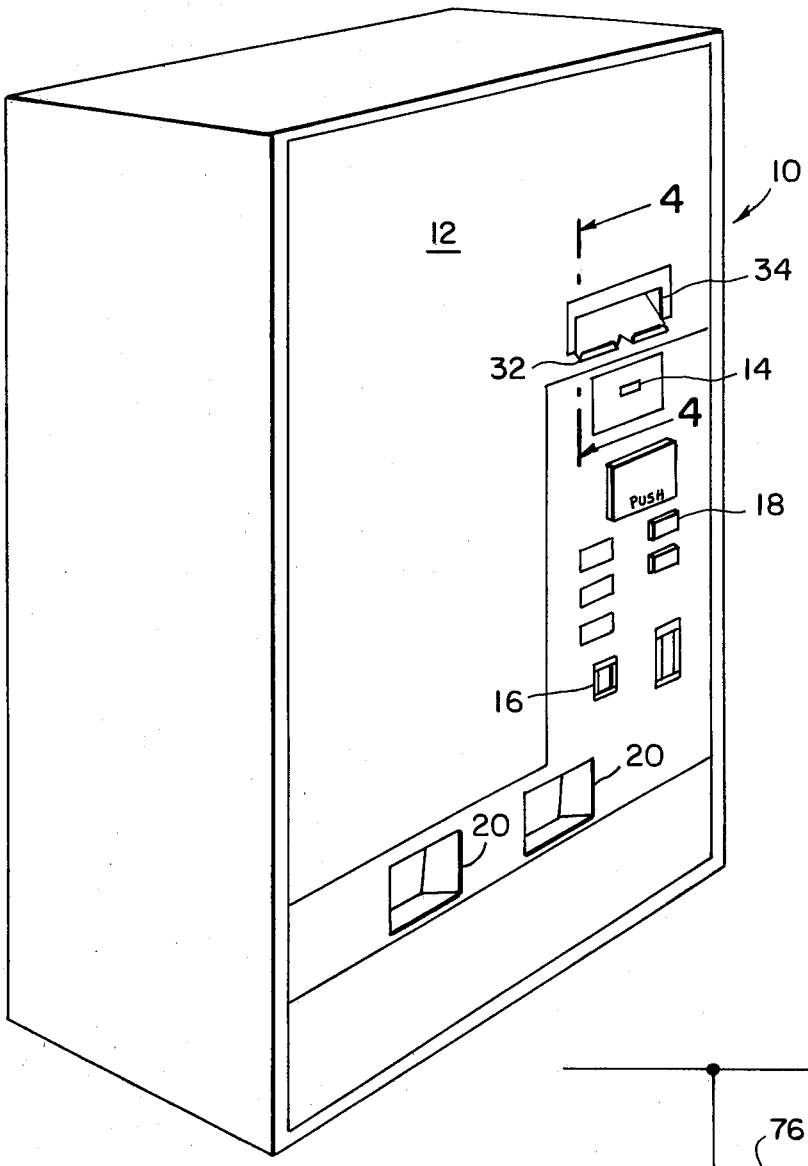
FIG. 1 is a perspective view of a vending machine in accordance with this invention. The vending machine contains conventional apparatus (not shown in FIG. 1) for automatically dispensing a product when the price of the product has been deposited in the machine and the product has been selected. The machine also contains an apparatus (not shown in FIG. 1) for automatically dispensing a card, in accordance with this invention, when the price of a product has been deposited in the machine and the product selection made.

As shown in FIG. 1, the vending machine 10 has a front wall 12 which includes: a conventional coin slot 14 into which a customer can insert the price of any of the products in the machine 10; a conventional coin return slot 16; a plurality of conventional select buttons 18 with which the customer can choose one of the products in the machine 10; and a plurality of conventional product hoppers 20 into which the machine 10 can automatically deposit the product that has been paid for, and then selected, by the customer.

As shown in FIGS. 2 to 8, the vending machine 10 also includes a card dispenser of this invention, generally 30. The card dispenser 30 is mounted on the rear of the machine's front wall 12. The card dispenser 30 is adapted to deposit a card in a chute 32 which extends through an opening 34 in the front wall 12 of the machine 10 as shown in FIG. 1. The card dispenser 30 automatically deposits a card in the chute 32 after a customer has inserted the price of a product into the coin slot 14 of the machine 10 and depressed one of the select buttons 18.

Figure 2:
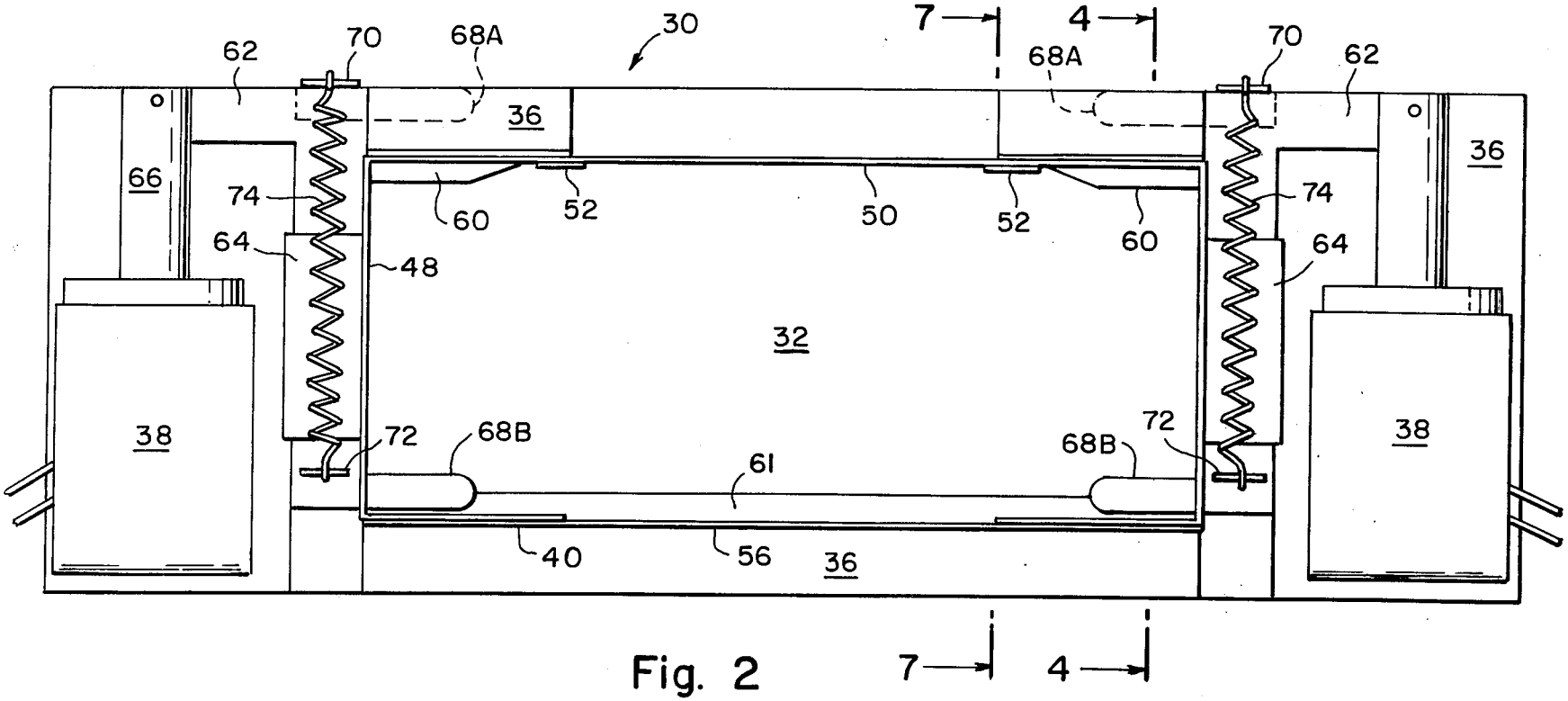
FIG. 2 is a top view of the card dispenser of this invention in the vending machine of FIG. 1.
Figure 3:
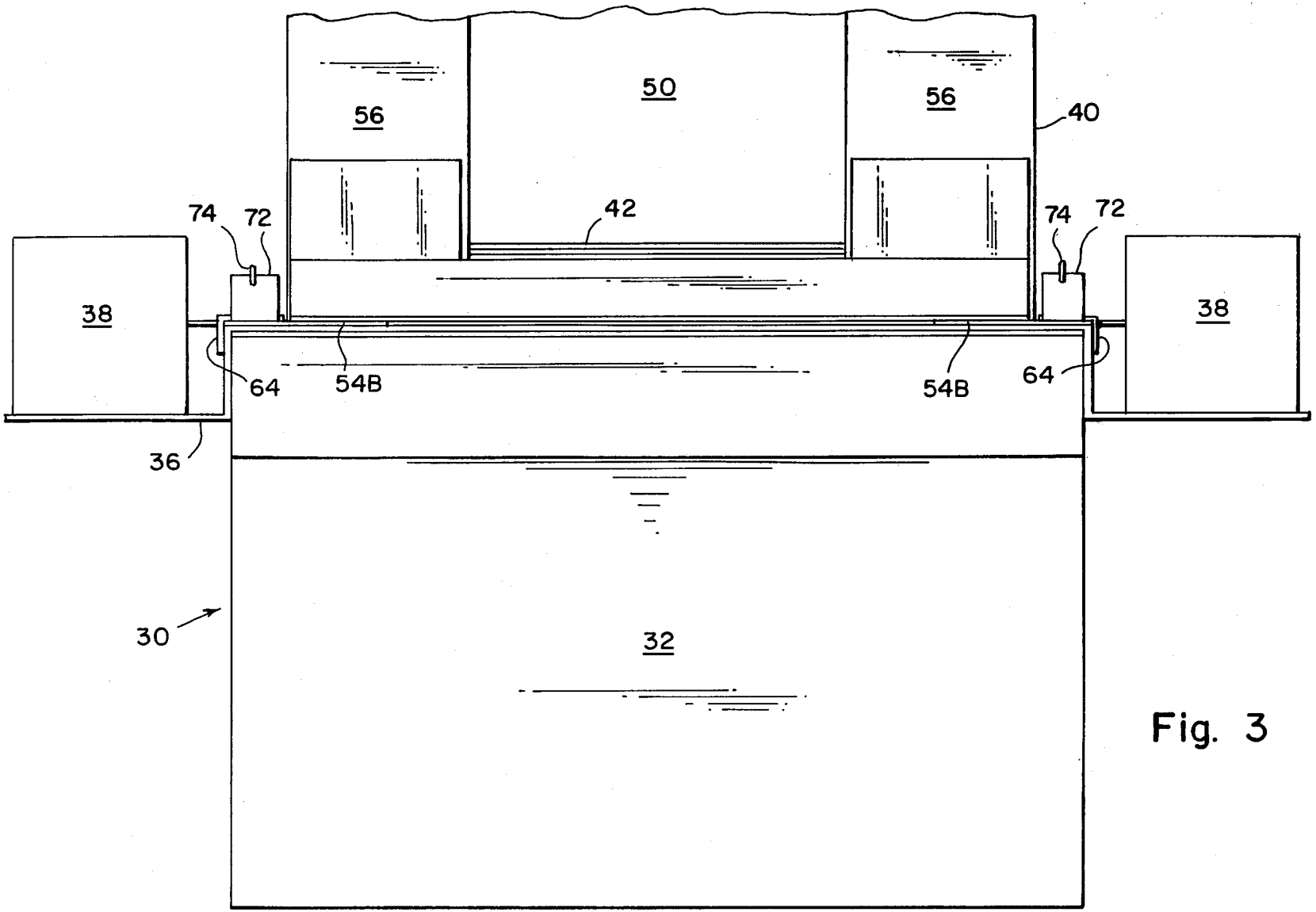
FIG. 3 is a rear view of the card dispenser of FIG. 2. A stack of cards, ready to be dispensed, is shown in the card dispenser.
Figure 4:
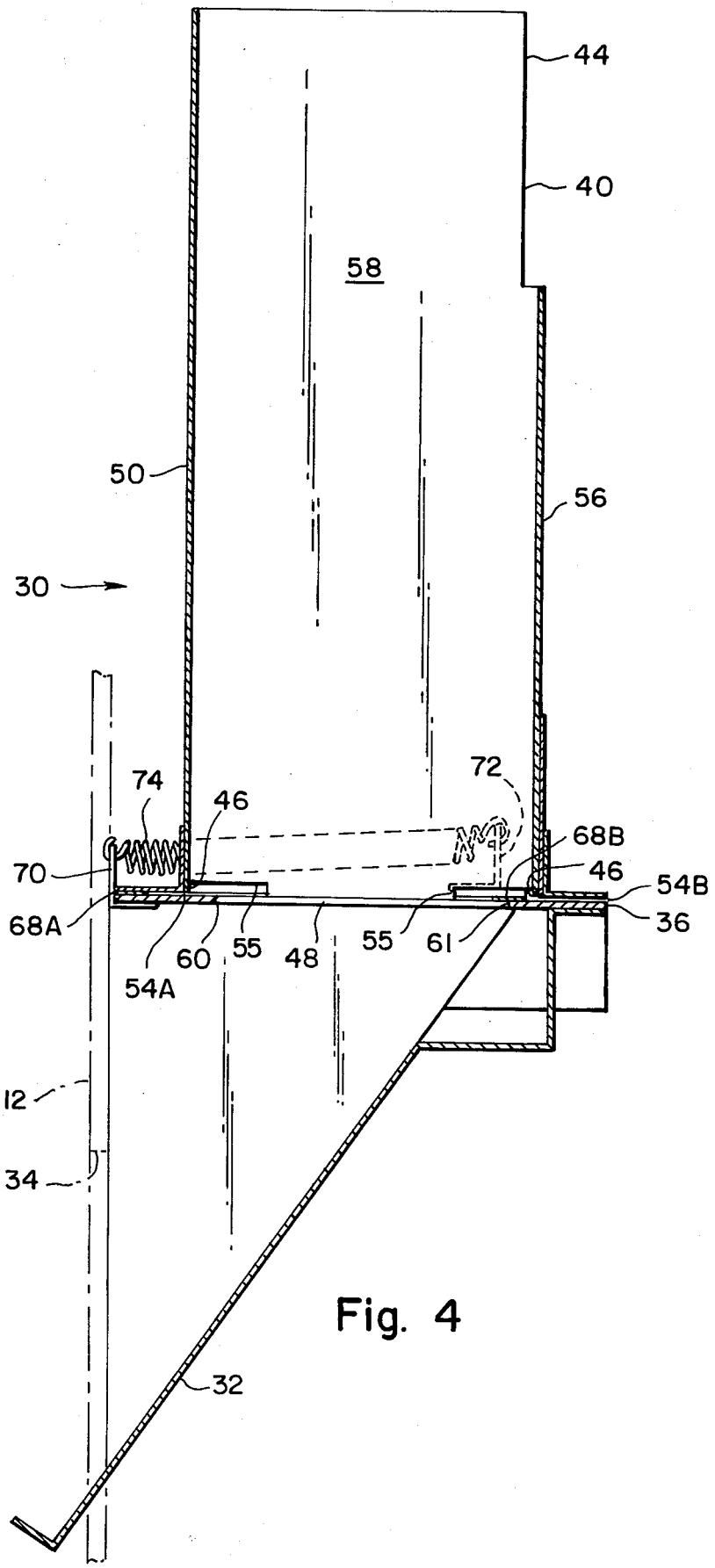
FIG. 4 is a sectional view, taken along line 4—4 in FIGS. 1 and 2.

Shown in FIGS. 2 to 4 is the card dispenser 30 before it has been activated by a customer depositing the price of a product into the coin slot 14. As best seen in FIG. 3, the card dispenser 30 has a generally horizontal platform 36 atop the chute 32. Mounted on the lateral ends of the platform 36 are a pair of solenoids 38, facing the front wall 12 of the vending machine 10. Between the solenoids 38 and mounted on the platform 36 is an upstanding, generally rectangular compartment or magazine 40 for a vertical stack 42 of generally rectangular cards, each of which is disposed generally horizontally.

As seen in FIG. 4, the top 44 of the compartment 40 is open to permit the stack 42 of cards to be placed in the compartment 40. The bottom 46 of the compartment 40 is open. The compartment bottom 46 communicates with a generally rectangular opening 48 in the platform 36, through which the cards of the stack 42 move downwardly in their feed path from the compartment 40 to the chute 32. Provided on the interior of the front wall 50 of the compartment 40 is at least one, preferably two, rigid, rearwardly extending, vertical strips 52. The strips 52 each extend downwardly from the top 44 of the compartment 40 through its bottom 46 and through the opening 48 in the platform 36.

As best seen in FIGS. 3 and 4, portions of the bottom of compartment 40 are spaced above the underlying portions of the top of platform 36 about the opening 48 in the platform. In this regard, a first vertical space 54A is provided between the lateral end portions of the front compartment wall 50 and the platform 36; a second vertical space 54B is provided between the rear compartment wall 56 and the platform 36; and a third vertical space 55 is provided between the front and rear, end portions of the compartment side walls 58 and the platform 36. Specific dimensions of the first, second and third vertical spaces 54A, 54B and 55 are not critical, so long as: (1) the height of the second vertical space 54B is at least equal to, preferably somewhat greater than, the thickness of one of the cards of the stack 42 but not as great as the thickness of two such cards; and (2) the second vertical space 54B extends along the entire length of the rear compartment wall 56. For example, the first and third vertical spaces 54A and 55 can, if desired, extend the entire lengths of the front and side compartment walls 50 and 58, respectively.

As shown in FIG. 2, at least one, preferably a pair of, rearwardly extending, generally horizontal ledges 60 are provided in the front of the opening 48 in the platform 36. The front ledges 60 are located about the pair of vertical strips 52. The top of each front ledge 60 is preferably coplanar with the top of the opening 48 in platform 36. Preferably, the front ledges 60 also have their rear edges beveled downwardly from rear to front. As also shown in FIG. 2, at least one, preferably one continuous, frontally extending, horizontal ledge 61 is provided in the rear of the opening 48 in the platform 36. Preferably, the top of the rear ledge 61 is coplanar with the top of the opening 48 in platform 36.

As shown in FIG. 4, the front and rear ledges 60 and 61 are below the stack 42 of cards in the compartment 40 and underlie simultaneously the stack of cards in the compartment. The ledges 60 and 61 serve to provide support to the stack of cards 42 in a manner which will be described below.

As seen from FIG. 2, a generally horizontal slider, generally 62, is provided on each lateral side of the card dispenser 30, between the compartment 40 and one of the solenoids 38. Between each slider 62 and its adjacent solenoid 38, an L-shaped retaining angle 64 is provided, one end of which is connected to the platform 36 as shown in FIG. 3. Each slider 62 rests atop the platform 36 and can move along the platform transversely of the feed path from the compartment 40 to the chute 32, i.e., each slider can move frontally and rearwardly between its adjacent compartment side wall 58 and an upstanding portion of its adjacent retaining angle 64.

As also seen from FIG. 2, the front of each slider 62 is connected to the movable arm 66 of the adjacent solenoid 38. Each movable arm 66 is adapted to urge rearwardly the slider 62, connected to it, when the solenoids 38 are energized. Each slider 62 is also provided with a pair of laterally extending fingers 68A and 68B. One finger 68A is located adjacent the front of each slider 62, and the other finger 68B is located adjacent the rear of each slider 62. Each front finger 68A and rear finger 68B can move frontally and rearwardly with their slider 62 along the top of the platform 36, above the opening 48 in the platform, and within the first, second and third, vertical spaces 54A, 54B and 55 between the compartment 40 and the platform 36. The specific vertical thickness of the fingers 68A and 68B is not critical, provided: (1) the fingers are no thicker than one of the cards of the stack 42; (2) the front finger 68A is thinner than the first and third vertical spaces 54A and 55 in which it moves; and (3) the rear finger 68B is thinner than the second and third vertical spaces 54B and 55 in which it moves. The specific distance between front and rear fingers 68A and 68B on each slider 62 also is not critical, provided the fingers are spaced farther apart than the front and rear edges of each of the cards of the stack 42.

Mounted on the front of the platform 36, between each of the solenoids 38 and its adjacent compartment side wall 58, is an upstanding front bracket 70, and mounted on each slider 62, rearwardly of a front bracket 70, is an upstanding rear bracket 72 as shown in FIGS. 2 to 4. Connected to each pair of front and rear brackets 70 and 72 is a spring 74 which is adapted to: (1) oppose rearward motion of its slider 62 when the solenoids 38 are energized; and (2) urge frontally its rear bracket 72 and its slider 62 when the solenoids 38 are subsequently deenergized.

Figure 8:
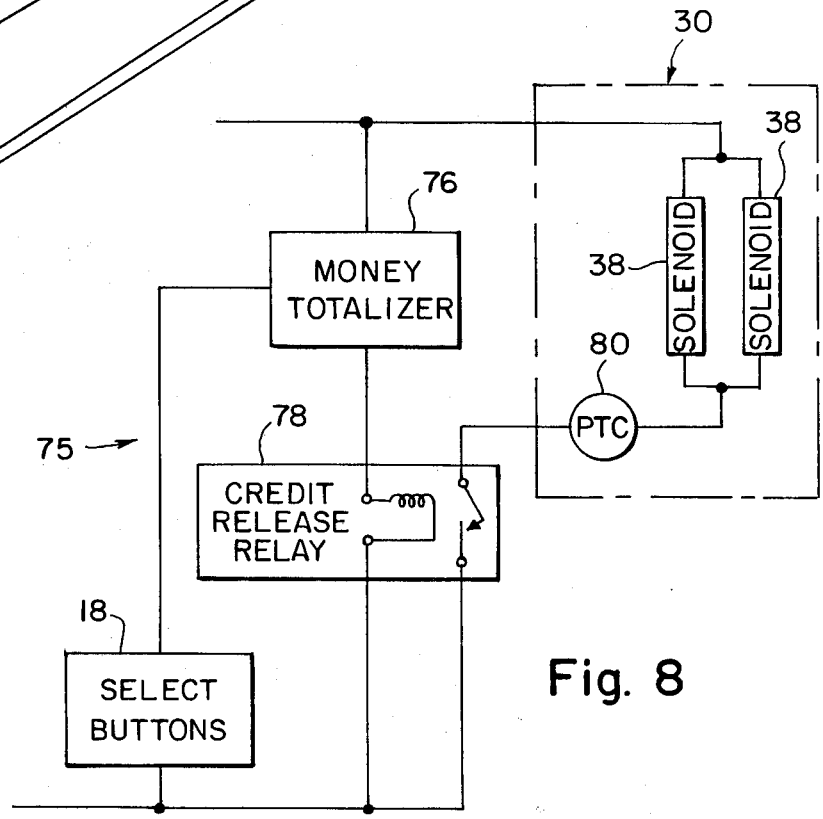
FIG. 8 is a schematic block diagram of the electric circuit, within the vending machine of FIG. 1, which automatically coordinates the dispensing of a product and the dispensing of a card from the machine.

The operation of the vending machine 10 of this invention is controlled by the circuit, generally 75, that is schematically shown in FIG. 8. In this regard, a conventional money totalizer 76 determines when a consumer has inserted, in the coin slot 14, the price of a product in the machine 10. Then, the money totalizer 76 completes the circuit to the select buttons 18 and energizes a conventional relay 78. Energizing the relay 78 causes a contact on the relay to close, thereby energizing the pair of solenoids 38 of the card dispenser 30. When a consumer subsequently pushes one of the select buttons 18 to obtain a product, the totalizer 76 resets and deenergizes the relay 78, thereby opening the contact on the relay and deenergizing the solenoids 38. Deenergizing the solenoids causes a card from the stack 42 within the card dispenser 30 to drop into the chute 32 and out of the machine 10 through the opening 34.

Preferably, the circuit 75 of FIG. 8 includes, as a safety feature, a conventional positive temperature coefficient sensor (PTC) 80. The PTC 80 detects any overheating of the solenoids 38 by sensing any increased current to them. When actuated, the PTC 80 causes a high resistance to enter the line between the contact on the relay 78 and the solenoids 38, thereby deenergizing the solenoids.

Figure 5:
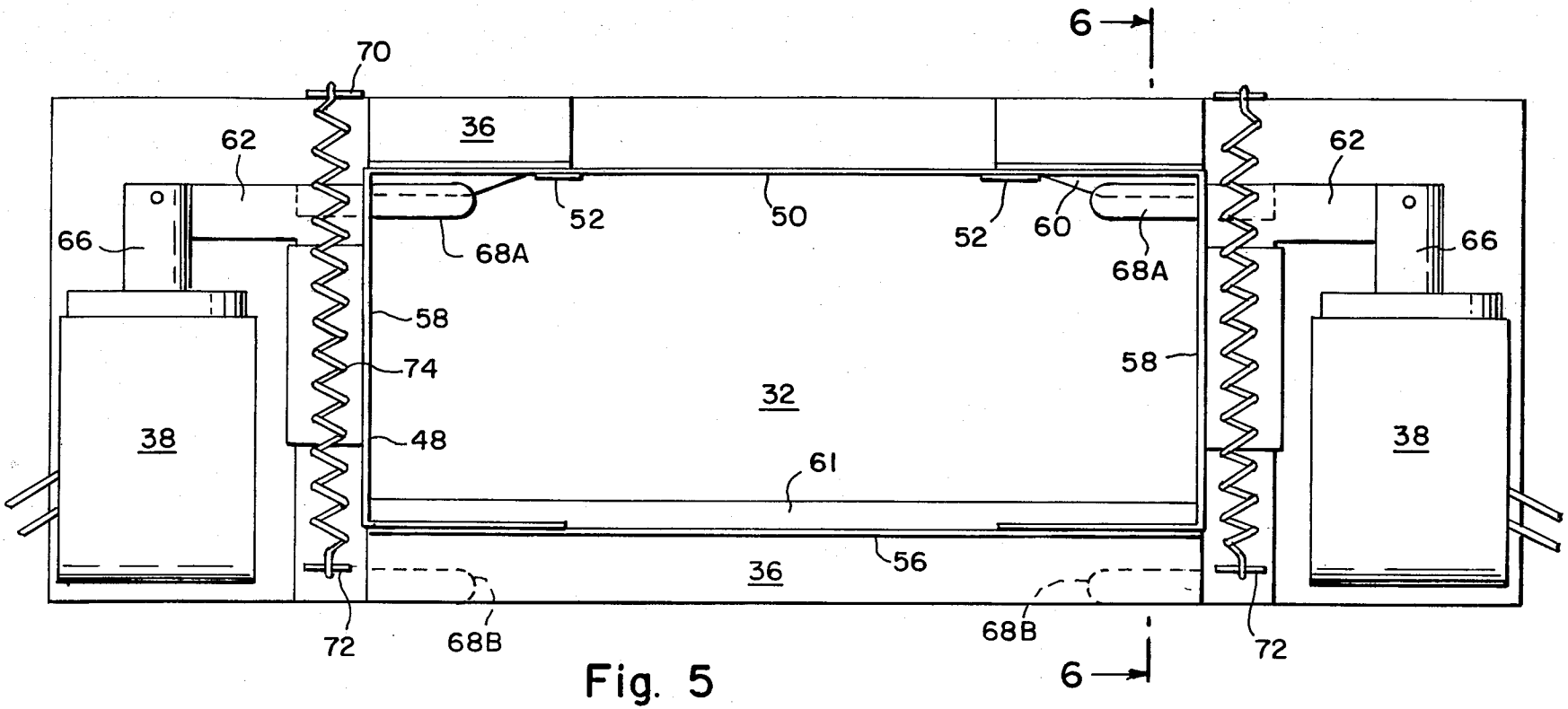
FIG. 5 is a top view of the card dispenser when it has been activated by the deposit of money in the vending machine.
Figure 7:
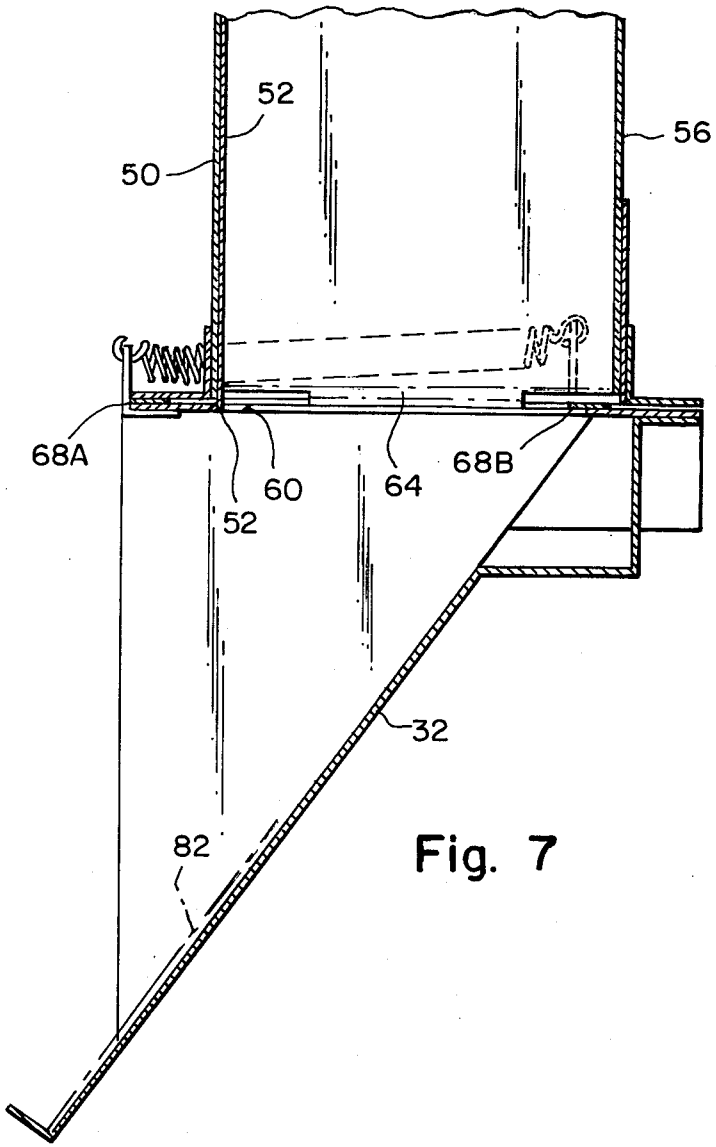
FIG. 7 is a sectional view, taken along line 7—7 in FIG. 2, showing the card dispenser after it has been activated and has dispensed a card.
Figure 6:
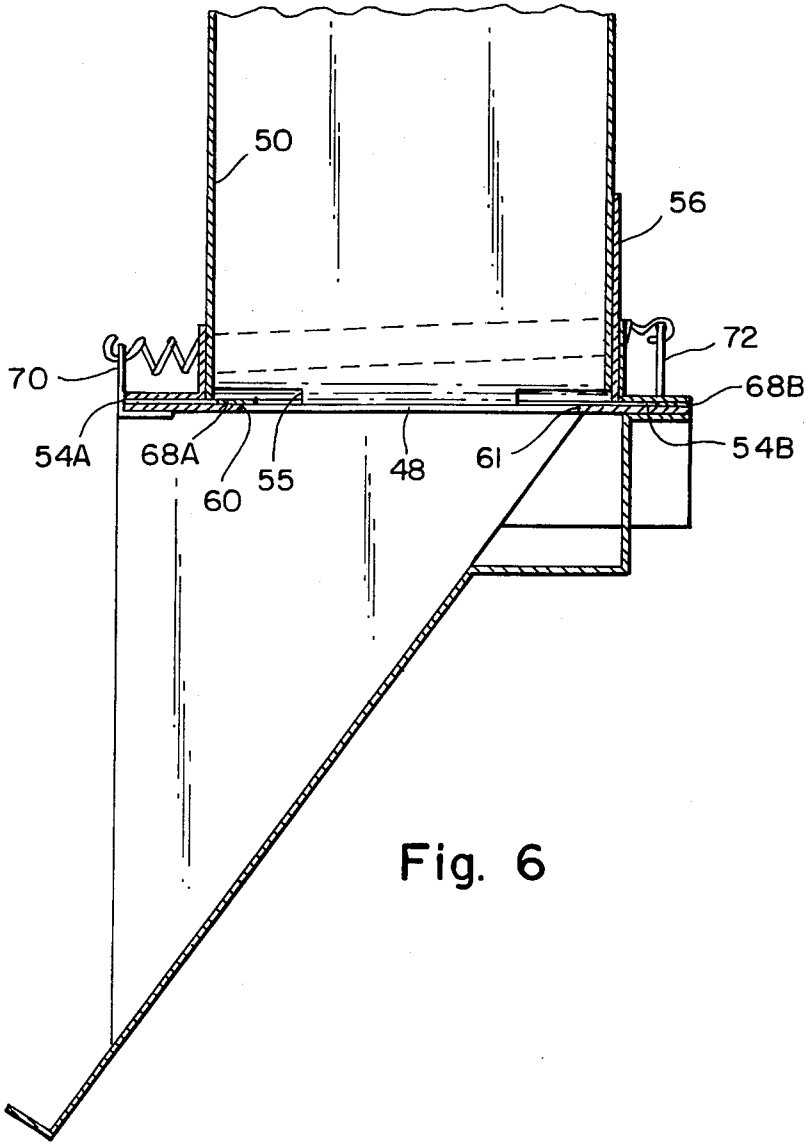
FIG. 6 is a sectional view, taken along line 6—6 in FIG. 5.

The operation of the card dispenser 30 in the vending machine 10 involves two basic steps as shown in FIGS. 2 to 7:

(1) Energizing the solenoids 38 by energizing the credit release relay 78; as shown in FIGS. 5 and 6, this causes the sliders 62, with their fingers 68A and 68B and their rear brackets 72, to move transversely of the feed path, i.e., rearwardly, so that the bottom card 82 (shown only in FIG. 7) of the stack 42 is moved transversely out of the feed path; as a result of such movement, the rear edge of the bottom card is restrained from moving along the feed path, i.e., downwardly, but the front edge of the bottom card is unsupported in the feed path and can move along the feed path; and (2) Subsequently deenergizing the solenoids 38 by deenergizing the relay 78; as shown in FIGS. 2 to 4 and 7, this causes the spring 74 to move the sliders 62, with their fingers 68A and 68B and their rear brackets 72, transversely of the feed path, i.e., frontally, so that the bottom card 82 of the stack 42 is moved transversely into the feed path; as a result of such movement, the bottom card is free to move along the feed path, i.e., downwardly through the opening 48 in the platform 36, on to the chute 32 and out the opening 34 of the machine 10 as shown in FIG. 7.

Before the solenoids 38 are energized, the stack 42 of cards rests in the compartment 40 with the bottom card 82 (shown only in FIG. 7) resting on the front ledges 60 in the opening 48 in the platform 36 and on the rear fingers 68B of the sliders 62. The front edge of the bottom card 82 is kept by the strips 52 out of the first vertical space 54A between the lateral end portions of the front compartment wall 50 and the platform 36.

Before the solenoids 38 are energized, the movable solenoid arms 66 and the sliders 62, along with their fingers 68A and 68B and their rear brackets 72, are in their frontmost position as shown in FIGS. 2 and 4.

When the solenoids 38 are energized by the credit release relay 78, the solenoid arms 66 move rearwardly. This causes the sliders 62 and their fingers 68A and 68B and their rear brackets 72 to also move rearwardly. The front fingers 68A move rearwardly in the first vertical space 54A between the lateral end portions of the front compartment wall 50 and the platform 36 and then rearwardly in the adjacent third vertical space 55 between the front end portions of the side compartment walls 58 and the platform 36 as shown in FIGS. 5 and 6. At the same time, the rear fingers 68B move rearwardly in the adjacent third vertical space 55 between the rear end portions of the side compartment wall 58 and the platform 36, out from under the bottom card of the stack 42, and then into the second vertical space 54B between the rear compartment wall 56 and the platform 36 as shown in FIGS. 5 and 6. As a result of the rearward movement of the rear fingers 68B, the rear edge of the bottom card of the stack 42 moves downwardly, under the weight of the stack 42, until the bottom card rests on the rear ledge 61. As a result of the rearward movement of the front fingers 68A against the front edge of the bottom card, the bottom card is moved rearwardly so that: (1) its rear edge is located within, and supported by, the second vertical space 54B in front of the rear fingers 68B; and (2) its front edge is to the rear of, and unsupported by, the front ledges 60. At this point in the operation of the card dispenser 30, the front edge of the bottom card is within the feed path and is free to move along the feed path, i.e., downwardly, but its rear edge is restrained from moving along the feed path by the second vertical space 54B. In this regard, the front edge of the bottom card should, at this point in the operation of the dispenser, be below the top of each of the front ledges 60, and the front edge of the next bottom card (not shown) of the stack 42 should be on the front fingers 68A.

When the solenoids 38 are thereafter deenergized by deenergizing the credit release relay 78, the sliders 62 are moved frontally, together with their fingers 68A and 68B and the solenoid arms 66, by the action of the springs 74. Thereby, the elements of the card dispenser 30 are returned to their original position as shown in FIGS. 2 to 4. The frontal movement of the sliders 62 causes the rear edge of the bottom card 82 of the stack 42 to be urged frontally out of the second vertical space 54B by the rear fingers 68B. This causes the unsupported front edge of the bottom card to move frontally and downwardly, beneath the beveled rear edge of each of the front ledges 60, until the bottom card falls, of its own weight, down through the opening 48 in platform 36 into chute 32 as shown in FIG. 7. At this point in the operation of the card dispenser 30, the next bottom card is on the front ledges 60 and on the rear fingers 68B, and the front edge of the next bottom card is prevented from entering the first vertical space 54A by the strips 52.

It is thought that the invention and many of its attendant advantages will be understood from the foregoing description, and it will be apparent that various changes can be made in the vending machine 10, its card dispenser 30 and in their method of operation without departing from the spirit and scope of the invention herein or sacrificing all of its material advantages, the apparatus, hereinbefore described, being merely a preferred embodiment.

In this regard, the card dispenser 30 can be used to dispense any card, sheet, film or the like of a relatively stiff paper, cardboard, plastic or the like (e.g., 0.012 inch paper). However, the cross-sectional configuration and/or the degree of flex of the card, sheet, film or the like should be such that the unsupported front edge thereof is below the top of each front ledge 60 when the rear edge thereof is located in, and supported by, the second vertical space 54B before the solenoids 38 are deenergized.

Also in this regard, the compartment 40, the opening 48 in the platform 36, and the cards in the stack 42 can have any other shape, besides rectangular, so long as their shapes are compatible and permit the cards to be properly dispensed, one at a time, from a stack.

Also in this regard, the terms herein, such as "front", "rear", "horizontal", "vertical", "lateral", "down", "bottom" and "top", are relative terms which describe the spatial relationships of the elements of the vending machine 10 and its card dispenser 30 as shown in FIGS. 1 to 8 but are not to be construed as limiting the invention in the machine and dispenser.

We claim:

1. A card dispenser, comprising:

(a) a compartment for a vertical stack of horizontally disposed cards; the compartment having an open bottom through which the cards can move downwardly;

(b) a horizontal platform, below the compartment, having an opening, below the open bottom of the compartment, through which the cards can move downwardly from the compartment; a horizontal ledge being provided in the front of the opening, extending rearwardly, and a horizontal ledge being provided in the rear of the opening, extending frontally; the front and rear ledges being adapted to underlie simultaneously the stack of cards in the compartment; the lateral end portions of the bottom of the front wall of the compartment being vertically spaced above the top of the platform; and the bottom of the rear wall of the compartment being vertically spaced above the top of the platform by at least the vertical thickness of one of the cards;

(c) a slider, located on the platform on one lateral side of the compartment and adapted to move rearwardly and frontally along the platform; the slider having a pair of laterally extending, front and rear fingers, spaced farther apart than the front and rear edges of each of the cards; the fingers having a vertical thickness no greater than one of the cards; the fingers being adapted to move horizontally between the platform and the compartment so that: (1) the front finger can urge rearwardly the front edge of the bottom card of the stack when the bottom card is on the front ledge and on the rear finger; and (2) the rear finger can urge frontally the rear edge of the bottom card of the stack when the rear edge of the bottom card is in the vertical space between the rear wall of the compartment and the platform; and (d) means for moving the slider: (1) rearwardly so that the front finger moves rearwardly out of the vertical space between the lateral end portions of the front wall of the compartment and the platform and against the front edge of the bottom card of the stack and the rear finger moves rearwardly out from between the bottom card and the rear ledge and into the vertical space between the rear wall of the compartment and the platform; and then (2) frontally so that the rear finger moves frontally against the rear edge of the bottom card in the vertical space between the rear wall of the compartment and the platform and the front finger moves frontally into the vertical space between the lateral end portions of the front wall of the compartment and the platform.

2. The dispenser of claim 1 which comprises two sliders on laterally opposite sides of the compartment; the fingers on one slider extending toward the fingers on the other slider.

3. The dispenser of claim 1 or claim 16 wherein the moving means (d) comprises a solenoid and a spring connected to the slider; the solenoid and spring opposing one another.

4. The dispenser of claim 1 wherein the front ledge is beveled downwardly from rear to front.

5. The dispenser of claim 1 or claim 4 which comprises two spaced front ledges and a single rear ledge.

6. The dispenser of claim 1 which comprises two spaced front ledges.

7. The dispenser of claim 6 which further comprises a rearwardly extending, vertical strip on the interior of the front wall of the compartment, between the two front ledges; the strip extending below the front ledges.

8. In a machine for automatically vending a product when the price of the product has been inserted into the machine, the improvement comprising a card dispenser, which comprises:

(a) a compartment for a vertical stack of horizontally disposed cards; the compartment having an open bottom through which the cards can move downwardly;

(b) a horizontal platform, below the compartment, having an opening, below the open bottom of the compartment, through which the cards can move downwardly from the compartment; a horizontal ledge being provided in the front of the opening, extending rearwardly, and a horizontal ledge being provided in the rear of the opening, extending frontally; the front and rear ledges being adapted to underlie simultaneously the stack of cards in the compartment; the lateral end portions of the bottom of the front wall of the compartment being vertically spaced above the top of the platform; and the bottom of the rear wall of the compartment being vertically spaced above the top of the platform by at least the vertical thickness of one of the cards;

(c) a slider, located on the platform on one lateral side of the compartment and adapted to move rearwardly and frontally along the platform; the slider having a pair of laterally extending, front and rear fingers, spaced farther apart than the front and rear edges of each of the cards; the fingers having a vertical thickness no greater than one of the cards; the fingers being adapted to move horizontally between the platform and the compartment so that: (1) the front finger can urge rearwardly the front edge of the bottom card of the stack when the bottom card is on the front ledge and on the rear finger; and (2) the rear finger can urge frontally the rear edge of the bottom card of the stack when the rear edge of the bottom card is in the vertical space between the rear wall of the compartment and the platform; and (d) means for moving the slider: (1) rearwardly so that the front finger moves rearwardly out of the vertical space between the lateral end portions of the front wall of the compartment and the platform and against the front edge of the bottom card of the stack and the rear finger moves rearwardly out from between the bottom card and the rear ledge and into the vertical space between the rear wall of the compartment and the platform; and then (2) frontally so that the rear finger moves frontally against the rear edge of the bottom card in the vertical space between the rear wall of the compartment and the platform and the front finger moves frontally into the vertical space between the lateral end portions of the front wall of the compartment and the platform; and (e) means for actuating the moving means (d) when the price of the product has been inserted into the machine.

9. The dispenser of claim 8 which comprises two sliders on laterally opposite sides of the compartment; the fingers on one slider extending toward the fingers on the other slider.

10. The dispenser of claim 8 or claim 9 wherein the moving means (d) comprises a solenoid and a spring connected to the slider; the solenoid and spring opposing one another.

11. The dispenser of claim 8 wherein the front ledge is beveled downwardly from rear to front.

12. The dispenser of claim 8 or claim 11 which comprises two spaced front ledges and a single rear ledge.

13. The dispenser of claim 8 which comprises two spaced front ledges.

14. The dispenser of claim 13 which further comprises a rearwardly extending vertical strip on the interior of the front wall of the compartment, between the two front ledges; the strip extending below the front ledges.

* * * * *